US005815133A

United States Patent [19]

Tsuboyama et al.

[11] Patent Number: 5,815,133

[45] Date of Patent: Sep. 29, 1998

[54] DISPLAY APPARATUS

[75] Inventors: Akira Tsuboyama; Hiroyuki Yokomizo, both of Atsugi; Mitsuo Iwayama, Odawara; Kazunori Katakura, Atsugi, all of Japan

[73] Assignee: Canon Kabushiki Kaisha, Tokyo, Japan

[21] Appl. No.: 715,137

[22] Filed: Sep. 18, 1996

Related U.S. Application Data

[63] Continuation of Ser. No. 152,022, Nov. 15, 1993, abandoned.

[30] Foreign Application Priority Data

| | | | |
|---|---|---|---|
| Nov. 17, 1992 | [JP] | Japan | 4-331065 |
| Dec. 10, 1992 | [JP] | Japan | 4-352175 |
| Dec. 18, 1992 | [JP] | Japan | 4-354847 |

[51] Int. Cl.[6] ..... G09G 3/36

[52] U.S. Cl. ..... 345/95; 345/99

[58] Field of Search ..... 345/94, 95, 97, 345/99, 100, 211, 212, 213

[56] References Cited

U.S. PATENT DOCUMENTS

| | | | |
|---|---|---|---|
| 4,639,089 | 1/1987 | Okada et al. | 350/341 |
| 4,655,561 | 4/1987 | Kanbe et al. | 350/350 S |
| 4,697,887 | 10/1987 | Okada et al. | 350/350 S |
| 4,709,994 | 12/1987 | Kanbe et al. | 350/350 S |
| 4,712,873 | 12/1987 | Kanbe et al. | 350/337 |
| 4,712,874 | 12/1987 | Sekimura et al. | 350/339 F |
| 4,836,656 | 6/1989 | Mouri et al. | 350/350 S |
| 4,902,107 | 2/1990 | Tsuboyama et al. | 350/350 |
| 4,958,915 | 9/1990 | Okada et al. | 345/97 |
| 5,041,821 | 8/1991 | Onitsuka et al. | 340/784 |
| 5,058,994 | 10/1991 | Mihara et al. | 359/56 |
| 5,151,803 | 9/1992 | Wakita et al. | 345/97 |
| 5,243,454 | 9/1993 | Nakamura | 345/94 X |
| 5,323,171 | 6/1994 | Yokouchi et al. | 345/94 |
| 5,400,049 | 3/1995 | Yoshii | 345/94 X |

FOREIGN PATENT DOCUMENTS

| | | | |
|---|---|---|---|
| 404138417 | 5/1992 | Japan | 345/102 |

OTHER PUBLICATIONS

Hinotani, K., Flat Fluorescent Lamp for LCD Back–Light, 1988 International Display Research Conference, pp. 52–55.

Y. Gohara et al., "A 1280×1280 Matrix–Addressed FLC Light Valve for the Image Projection Display," SID International Symposium Digest of Technical Papers, pp. 257–260 (1991).

*Primary Examiner*—Steven J. Saras
*Assistant Examiner*—Vincent F. Kovalick
*Attorney, Agent, or Firm*—Fitzpatrick, Cella, Harper & Scinto

[57] ABSTRACT

A display apparatus includes a display panel having a matrix structure formed by a scan electrode group and a data electrode group, a scan electrode drive unit for operating the scan electrode group, a data electrode drive unit for operating the data electrode group, and a switching unit for switching on/off the electrical connection between a drive voltage generating unit for supplying drive voltage to the drive unit and a power supply source for supplying power to the drive voltage generating unit. Also included is a detection unit for detecting that the switching unit has been switched off, and a control unit for controlling the scan electrode drive unit and data electrode drive unit to apply a display drive signal for causing the display panel to display a desired image according to image information when the switching unit is switched on and to apply, to the scan electrode group and the data electrode group, non-pixel portion control voltage signals for controlling the optical state of liquid crystal in non-pixel portions which are regions except for intersection portions between the scan electrode group and the data electrode group immediately after or after the switching unit has been switched off.

24 Claims, 18 Drawing Sheets

DISPLAY APPARATUS

This application is a continuation of Application Ser. No. 08/152,022 filed Nov. 15, 1993, now abandoned.

BACKGROUND OF THE INVENTION

1. Field of the Invention

The present invention relates to a display apparatus, and more particularly to a display apparatus using a ferroelectric liquid crystal device.

2. Related Background Art

A liquid crystal apparatus of a type using liquid crystal, such as ferroelectric liquid crystal, that has characteristics (memory characteristics) with which the optical state can be maintained even if no electric signal is applied, does not encounter critical image quality deterioration even if a simple matrix structure is employed which can easily be manufactured. Therefore, a precise liquid crystal apparatus having a large image plane can be manufactured. As a result, the liquid crystal apparatus of the foregoing type has energetically been developed and researched in recent years.

The simple matrix structure has display portions at the intersection portions of the data electrode group and the scan electrode group. When electric signals are applied to the respective electrodes in accordance with image signals, an electric field is applied to the liquid crystal so that information is displayed. However, regions between pixels (non-display portions) can easily be affected by the adjacent display portions, resulting in deterioration of the image quality, such as irregular display, due to the bistability of the ferroelectric liquid crystal depending upon the state of the non-display portions. Accordingly, a method for controlling the non-display portions has been disclosed in, for example, "Iwai et al., Japanese Display '89 Proceeding, P180–183 (1989)", "Wakita et al., Abstract of the 2nd Int. Sympo. on FLC P14 (1989)" and "Gohara SID 91 digest, P257". The foregoing methods for controlling the non-display portions apply voltage for controlling the non-display portion to each frame and to apply voltage for controlling the non-display portions to each line before a select signal is applied.

Since the foregoing methods for controlling the non-display portions are basically arranged so that the voltage for controlling the non-display portions is, during a period in which the drive voltage is applied, applied through the electrode group which forms the pixels, a problem arises in that the display state is adversely affected. What is worse, the drive control system is too complicated.

SUMMARY OF THE INVENTION

An object of the present invention is to provide a display apparatus having a drive control system capable of preventing the generation of display irregular ities and improving the display quality while eliminating a necessity of using a complicated drive control system.

According to one aspect of the present invention, there is provided a display apparatus comprising: a display panel having a matrix electrode structure in which pixel regions are formed by intersection portions of scan electrodes and data electrodes and non-pixel regions are formed by non-intersection portions; drive means for applying scan signals to the scan electrodes and applying data signals to the data electrodes in synchronization with the scan signals; drive voltage generating means for supplying drive voltage to the drive means; power supply source for supplying power to the drive voltage generating means; switching means for switching on/off the electrical connection between the drive voltage generating means and the power supply source; detection means that detects whether the switching means has been switched on to generate a detection signal; and control means for, in response to receipt of the detection signal, controlling the drive means to apply, to the matrix electrode structure, signal voltage, the level of which is sufficiently high to make the optical state of the non-pixel regions to be uniform, before data is written on to the pixel regions by operating the drive means.

According to another aspect of the present invention, there is provided a display apparatus comprising: a display panel having a matrix electrode structure in which pixel regions are formed by intersection portions of scan electrodes and data electrodes and non-pixel regions are formed by non-intersection portions; drive means for applying scan signals to the scan electrodes and applying data signals to the data electrodes in synchronization with the scan signals; drive voltage generating means for supplying drive voltage to the drive means; power supply source for supplying power to the drive voltage generating means; switching means for switching on/off the electrical connection between the drive voltage generating means and the power supply source; detection means that detects whether that the switching means has been switched on to generate a detection signal; and control means for, in response to receipt of the detection signal, controlling the drive means to apply, to the matrix electrode structure, signal voltage, the level of which is sufficiently high to make the optical state of the non-pixel regions to be a uniform state, after data has been written on to the pixel regions by operating the drive means.

According to another aspect of the present invention, there is provided a display apparatus comprising: a display panel having a matrix electrode structure in which pixel regions are formed by intersection portions of scan electrodes and data electrodes and non-pixel regions are formed by non-intersection portions; drive means for applying scan signals to the scan electrodes and applying data signals to the data electrodes in synchronization with the scan signals; drive voltage generating means for supplying drive voltage to the drive means; power supply source for supplying power to the drive voltage generating means; switching means for switching on/off the electrical connection between the drive voltage generating means and the power supply source; and control means for controlling the drive means to write data onto the pixel regions after the switching means has been switched on, to interrupt, in accordance with receipt of a signal for interrupting the writing operation, the writing operation when the control means has received, during the writing operation, the signal for interrupting the writing operation and to apply, to the matrix electrode structure, signal voltage, the level of which is sufficiently high to make the optical state of the non-pixel regions to be a uniform state.

Other and further objects, features and advantages of the invention will be appear more fully from the following description.

DETAILED DESCRIPTION OF THE INVENTION

Preferred embodiments of the present invention will now be described.

Figure 1:
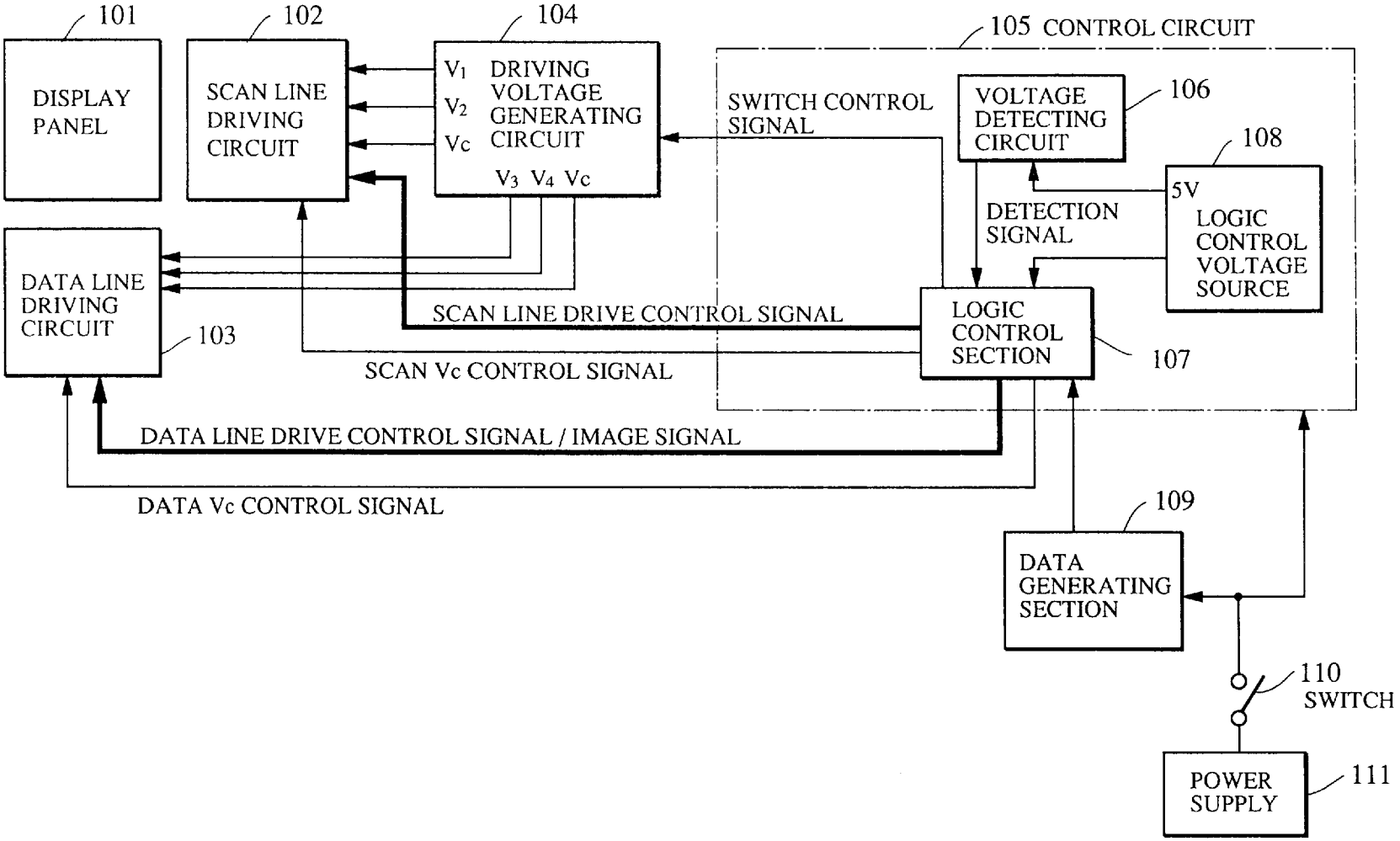
FIG. 1 is a block diagram which illustrates a display apparatus.

FIG. 1 is a block diagram of a liquid crystal display apparatus. Referring to FIG. 1, reference numeral 101 represents a liquid crystal panel having scan electrodes and data electrodes. Ferroelectric liquid crystal (omitted from illustration) is disposed between the electrode groups so that a matrix structure is formed. Intersection portions between the scan electrodes and the data electrodes serve as display portion 12 (see FIG. 6). The residual portions serve as non-display portions 11 (see FIG. 6). Reference numeral 102 represents a scan electrode drive circuit for operating the scan electrodes and 103 represents a data electrode drive circuit for operating the data electrodes. Reference numeral 104 represents a drive voltage generating circuit (Power Supply) for supplying voltages $V_1$, $V_2$ and $V_c$ to the scan electrode drive circuit 102 and supplying voltages $V_3$, $V_4$ and $V_c$ to the data electrode drive circuit 103. Reference numeral 105 represents a control circuit for controlling the scan electrode drive circuit 102, the data electrode drive circuit 103 and the drive voltage generating circuit 104. Reference numeral 107 represents a logic control circuit, 108 represents a logic control voltage source and 109 represents a data generating section.

Figure 2:
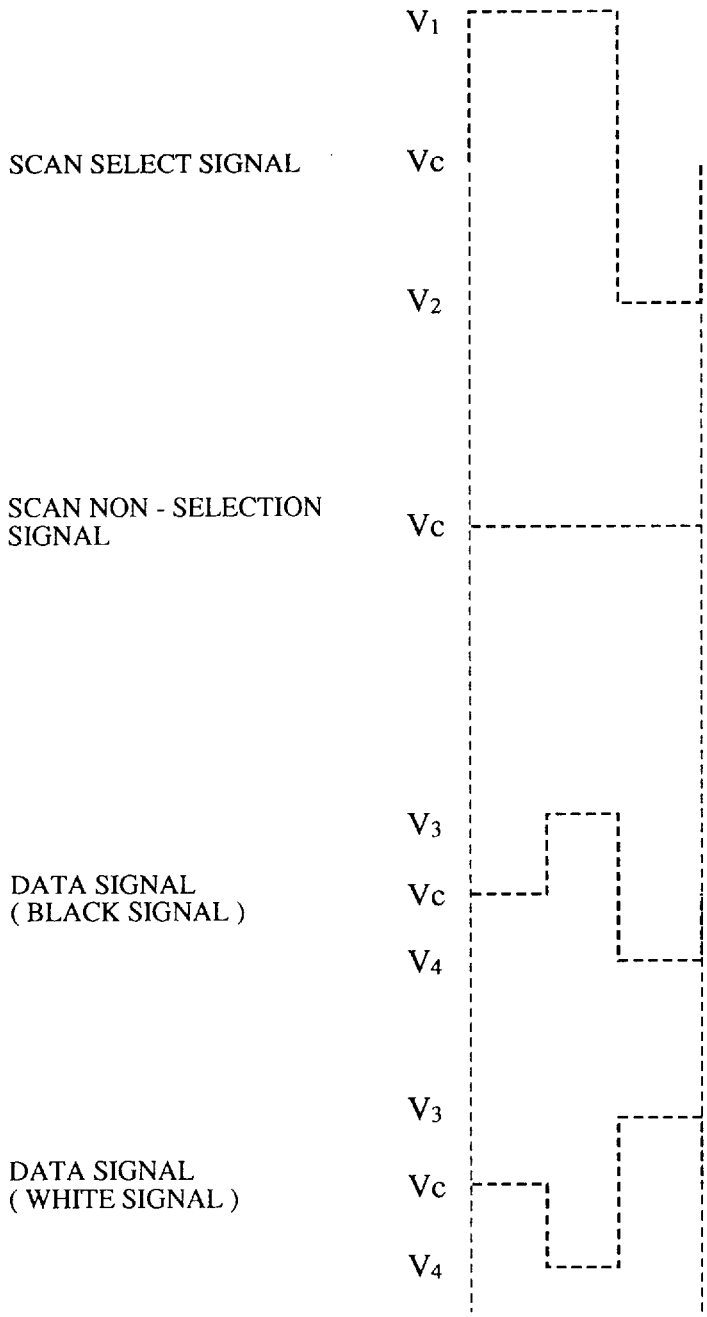
FIG. 2 is a graph which illustrates the waveforms of display drive signals for use in the present invention.

The aforementioned control circuit 105 and the drive voltage generating circuit 104 apply signals according to image information to the scan electrode drive circuit 102 and the data electrode drive circuit 103 so that white and black data signal voltages each composed of voltages $V_3$, $V_4$ and $V_c$ are transmitted to the data electrodes (see FIG. 2).

Figure 3:
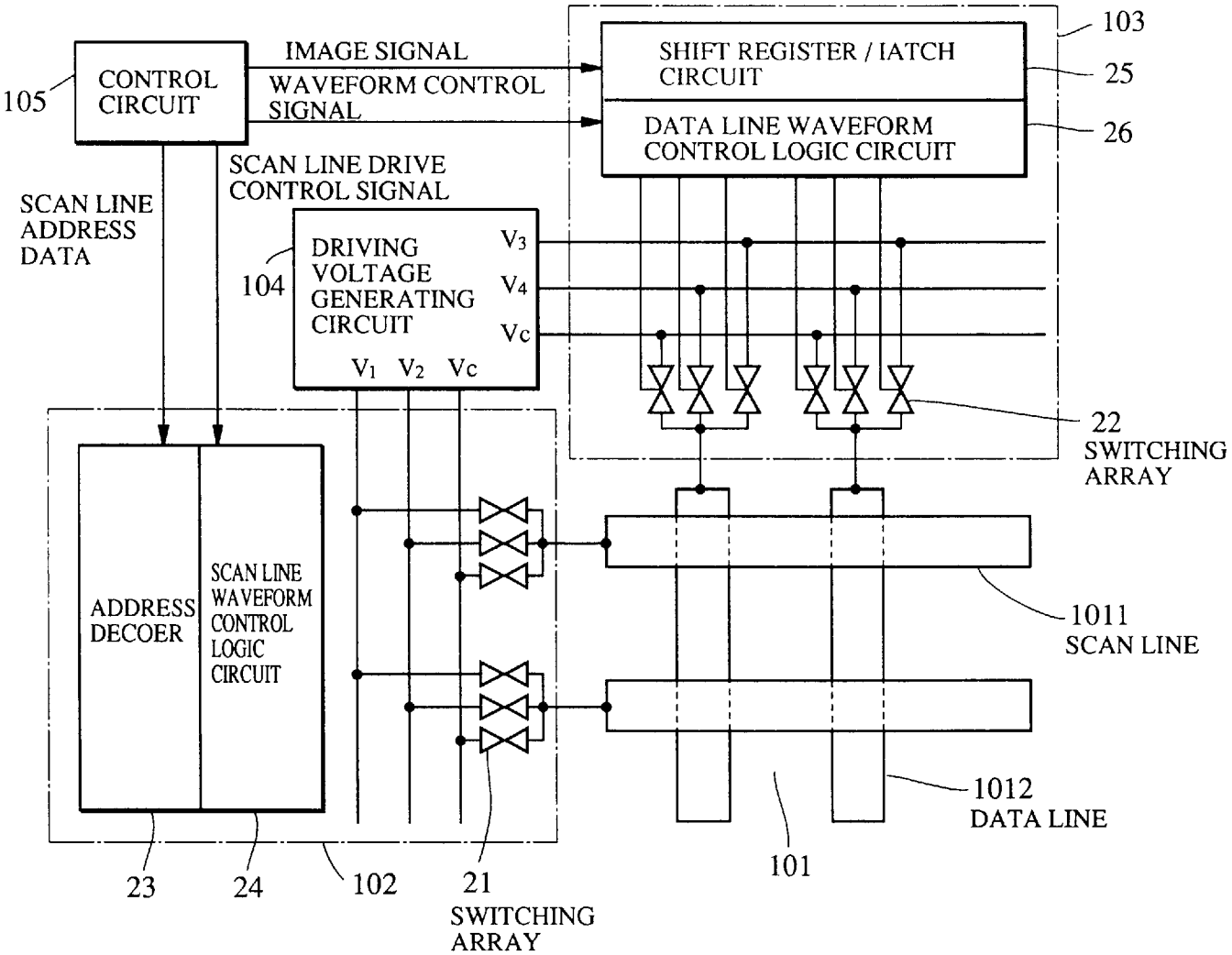
FIG. 3 is a detailed block diagram which illustrates the display apparatus according to the present invention.

FIG. 3 is a block diagram which illustrates the detailed structure of the scan electrode drive circuit 102 and the data electrode drive circuit 103. The scan electrode drive circuit 102 comprises: an address decoder 23 for decoding scan electrode address data of a scan electrode drive control signal; and a scan electrode waveform control logic circuit 24 for starting a switching array 21 which sequentially transmits scan selection signals shown in FIG. 2 to the scan electrode 1011. The data electrode drive circuit 103 comprises: a shift register/latch circuit 25 for converting image signals supplied serially into parallel signals; and a data electrode waveform control logic circuit 26 that generates the data signal voltages shown in FIG. 2 in accordance with the image information and that starts a switching array 22 which transmit the data signal voltages to the data electrodes 1012.

Figure 4:
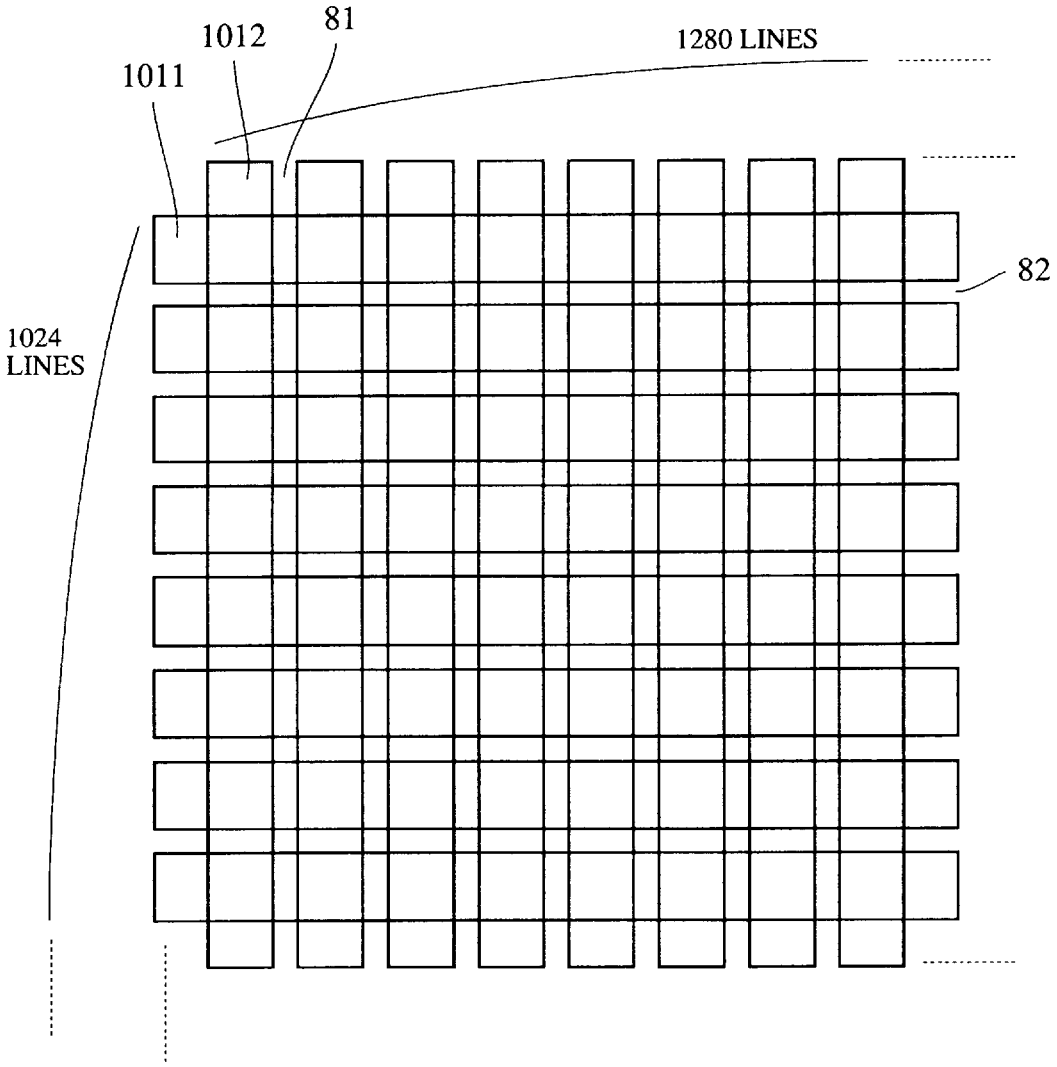
FIG. 4 is a partial top view which illustrates a liquid crystal panel according to the present invention.

FIG. 4 is a top view which illustrates a liquid crystal panel for use in the first embodiment, in which the data electrodes 1012 and the scan electrodes 1011 are disposed in the form of a matrix. The display portions (pixels) 12 and the pitch are determined as follows:

Number of pixels: 1280×1024

Pixel pitch: 215 $\mu$m

Width of Non-display portion: 10 $\mu$m.

Further, phenyl pyrimidine type ferroelectric liquid crystal is employed in this embodiment which has the following phase transition characteristics and the spontaneous polarization characteristics:

| (°C.) | −10 | 65 | 85 | 95 |
|---|---|---|---|---|
| Phase transition (°C.): | Crystal ←→ SmX* ←→ Sma ←→ Ch ←→ Iso | | | |
| Spontaneous polarization: | 5.5 nc/cm$^2$ | | | |

The data electrodes 1012 and the scan electrodes 1011 were made of transparent ITO in such a manner that ITO was applied to a glass substrate, patterning was performed to form a stripe shape so that the data electrodes 1012 and the scan electrodes 1011 were formed. Then, polyimide was applied and baked and a rubbing process was performed. The two substrates, on each of which the electrodes were formed, were bonded to each other while maintaining a predetermined interval. The bonded substrates were heated to a temperature at which the Iso state was realized. Further, liquid crystal in the liquid form was injected into the aforementioned. Then, the temperature was lowered at a rate of 1° C./minute. The state of orientation in the non-display portion 11 was observed while holding the substrates between cross nicol deflection plates. As a result, two states were present irregularly over the liquid crystal panel. This fact means that the conventional drive method manifests an irregular display.

Figure 5:
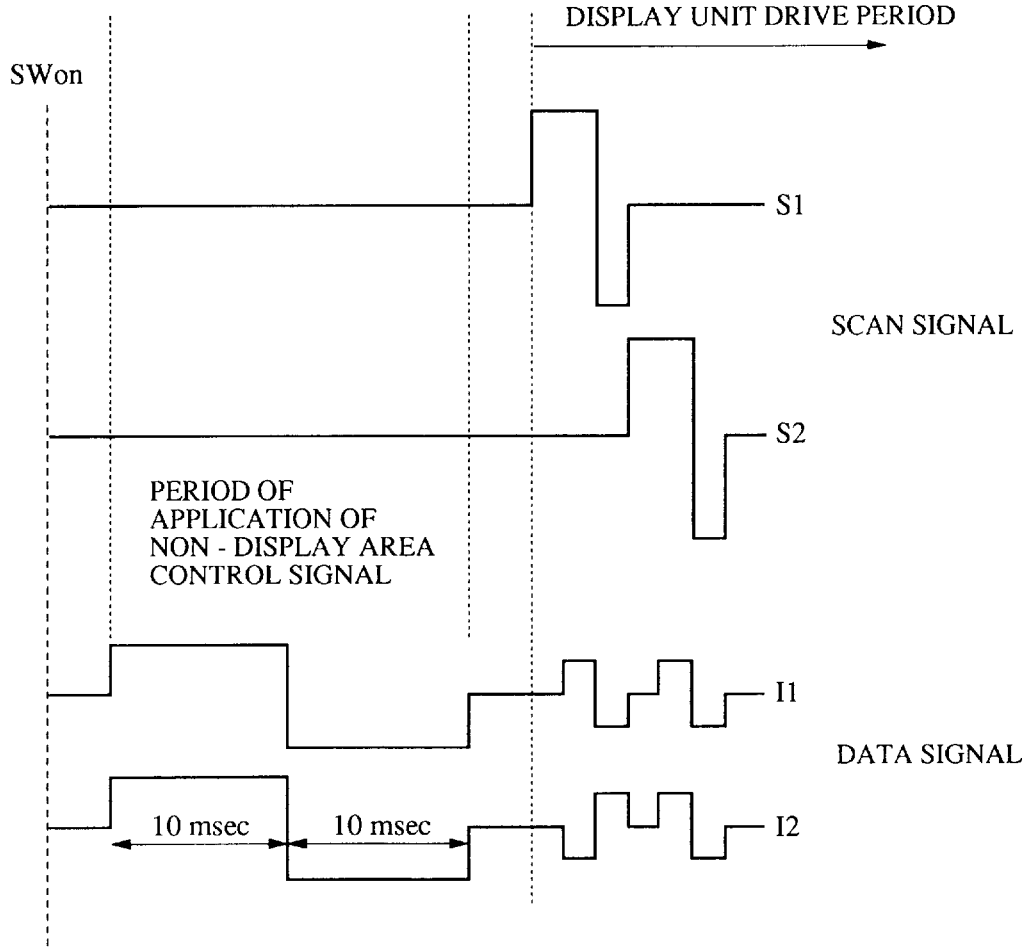
FIG. 5 is a timing chart which illustrates display drive signals for use in the present invention.

The liquid crystal panel of the foregoing type was applied with electric signals at timing shown in FIG. 5. Referring to FIG. 5, reference numerals S1, S2, I1 and I2 represent signals applied to one of the multiple data electrodes 1012 and the scan electrodes 1011. The drive waveform for operating the liquid crystal panel is shown in FIG. 2. The drive conditions at this time were as follows: V1=15V, V2=−15V, V3=5V, V4=−5V and the time to scan one line was 130 $\mu$sec.

Figure 6:
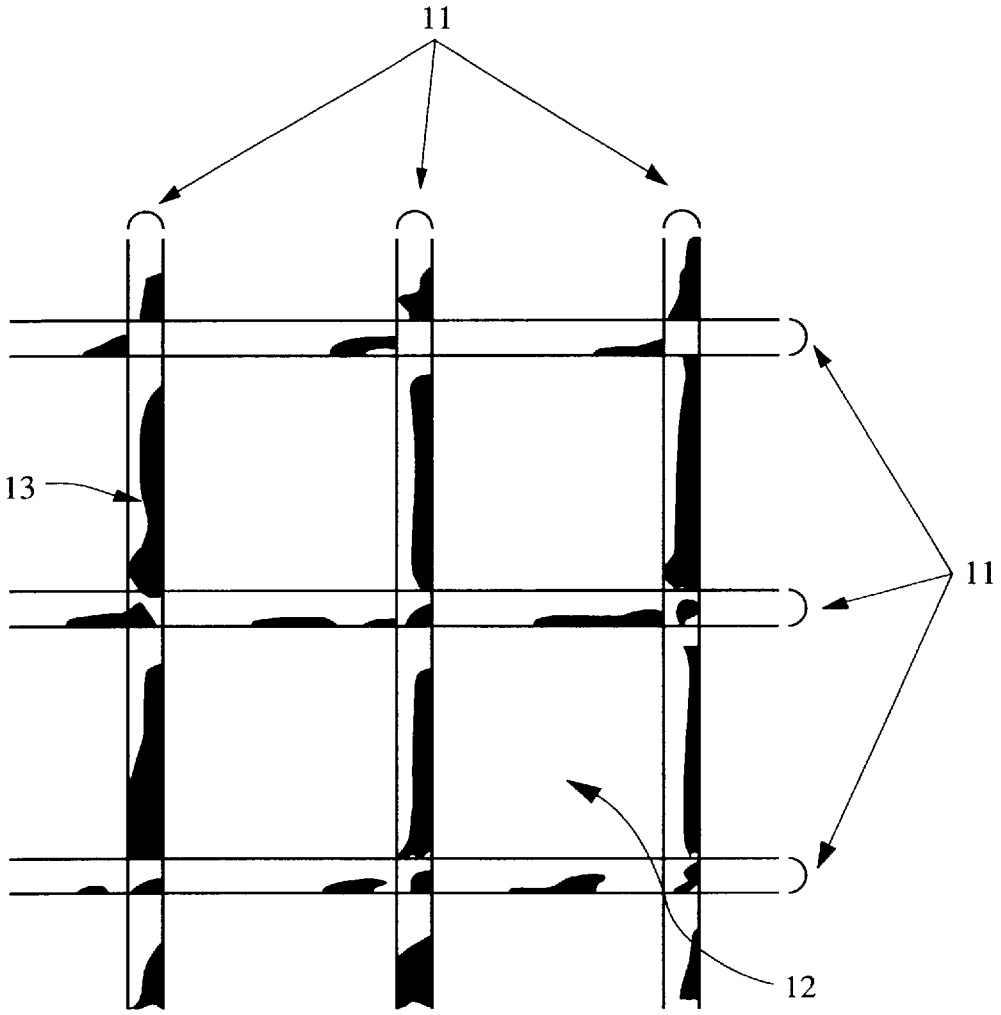
FIG. 6 is a view which illustrates irregular display.

When drive waveform for display is applied in a state where the non-display portion 11 is not controlled after the switched has been switched on, irregular displays 13 were observed depending upon the states of the non-display portions 11. FIG. 6 shows the state of the non-display portions 11 when observed with a microscope. The electric signal needed to change the state of the non-display portions 11 was investigated by performing the following experiment. In a state where the scan line driver was maintained at Vc, bipolar pulses of ±5V with respect to Vc were simultaneously applied from the data signal portion to all data lines while varying the pulse width to measure the pulse width which changed the state of the non-display portions 11. As a result, it was found that the non-display portions 11 were inverted when the pulse width was 5 msec or wider. Therefore, non-display portion control signals, having a pulse width (±5V and pulse width was 10 msec) wider than the width with which the non-display portions 11 were inverted, were applied after the switch had been switched on. As a result, all non-display portions 11 were controlled to the dark state. When the display drive signals were applied afterwards to display a desired image, an excellent image without irregular display over the image plane could be realized.

That is, the application of the data signals in the form of bipolar pulses of ±5V and each having the pulse width of 5 msec to the data electrodes 1012 enabled the non-display portions 11 to be controlled. As a result, the irregular display can be prevented.

Assuming that the threshold voltage for changing the optical state of the ferroelectric liquid crystal in the display portions 12 by the application of the signals to the scan electrodes 1011 and the data electrodes 1011 is V1 and the threshold voltage for changing the optical state of the ferroelectric liquid crystal in the non-display portions 11 is V2, the voltage level of the non-display portion control signal is determined to be higher than V2 and the voltage of the display portion drive signal is determined to be a level between V1 and V2.

Further, it is preferable that the pulse width of the non-display portion control signal be 100 μsec to 1 sec.

Figure 7B:
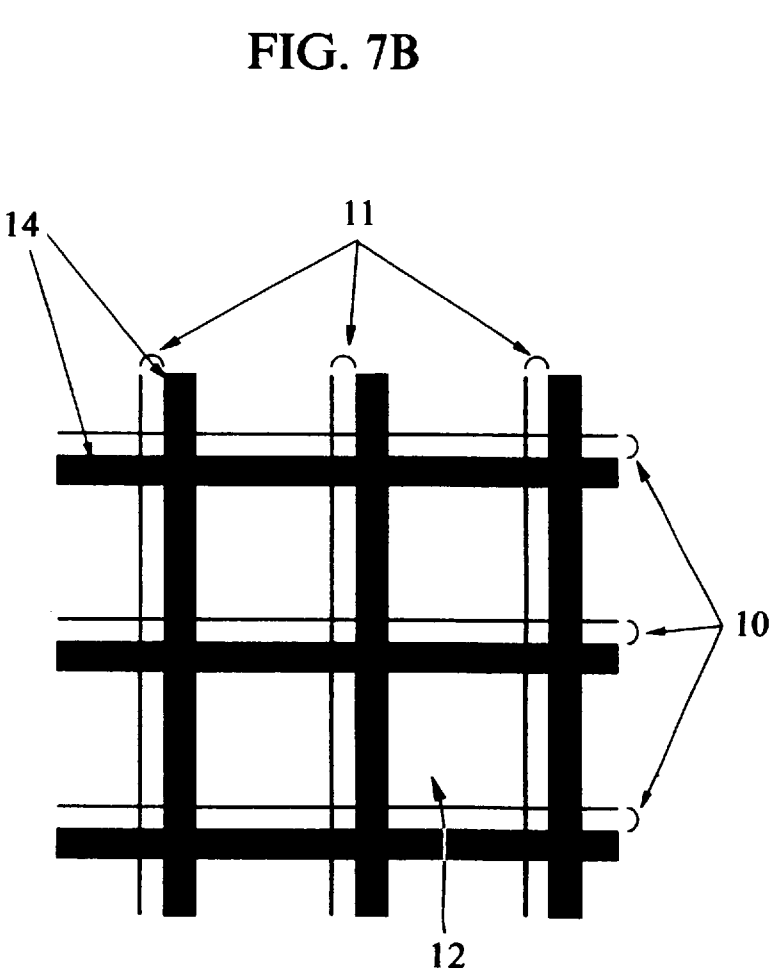
FIG. 7A is a top view which illustrates a liquid crystal panel having metal lines and according to the present invention and FIG. 7B shows an area of detail of the panel.
Figure 7A:
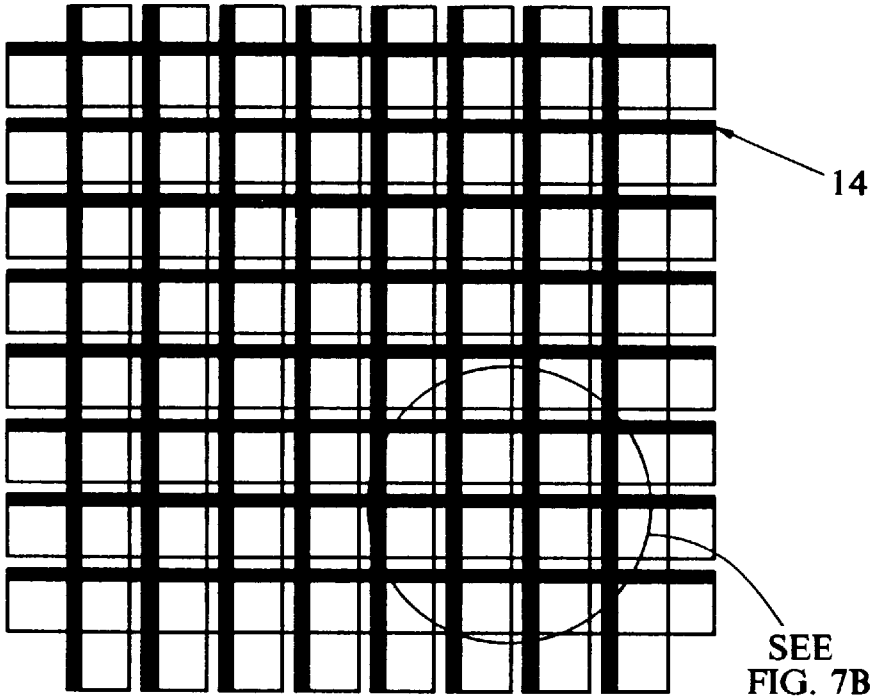

A second embodiment of the present invention will now be described. Since the basic structure of a liquid crystal apparatus according to the second embodiment is substantially the same as the first embodiment, the same elements are given the same reference numerals and their descriptions are omitted here. FIGS. 7A and 7B constitute, respectively, a top view and an area of detail thereof which illustrate the liquid panel according to this embodiment and comprising stripe-shape metal lines 14 formed in a portion of the data electrodes 1011 and that of the scan electrodes 1012. When the display drive signals shown in FIG. 5 were applied, an image without the irregular display was obtained.

It should be noted that the metal line has an advantage that the potential of the portions of the non-display portions 11 that are in contact with the metal lines can be lowered.

Figure 8:
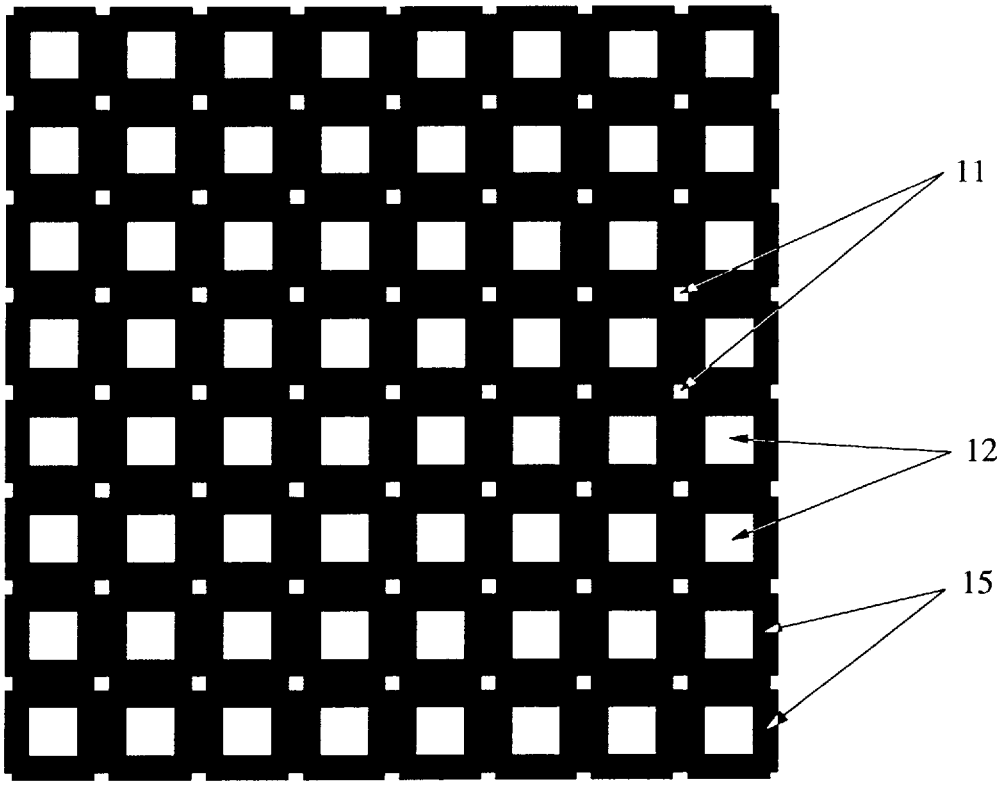
FIG. 8 is a top view which illustrates a liquid crystal panel having metal lines and according to the present invention.

A third embodiment of the present invention will now be described. Since the basic structure of a liquid crystal apparatus according to the third embodiment is substantially the same as the first embodiment, the same elements are given the same reference numerals and their descriptions are omitted here. This embodiment has the same arrangement as that of the first embodiment except for ladder-type metal lines 15 are formed in a portion of the data electrodes 1012 and that of the scan electrodes 1011 as shown in FIG. 8. The non-display portion control signal was evaluated, the result of which was that the non-display portions 11 was inverted under substantially the same conditions as that of the first embodiment. When a signal group similar to that according to the first embodiment and shown in FIG. 5 was applied, an image free from the irregular display was realized.

Figure 9:
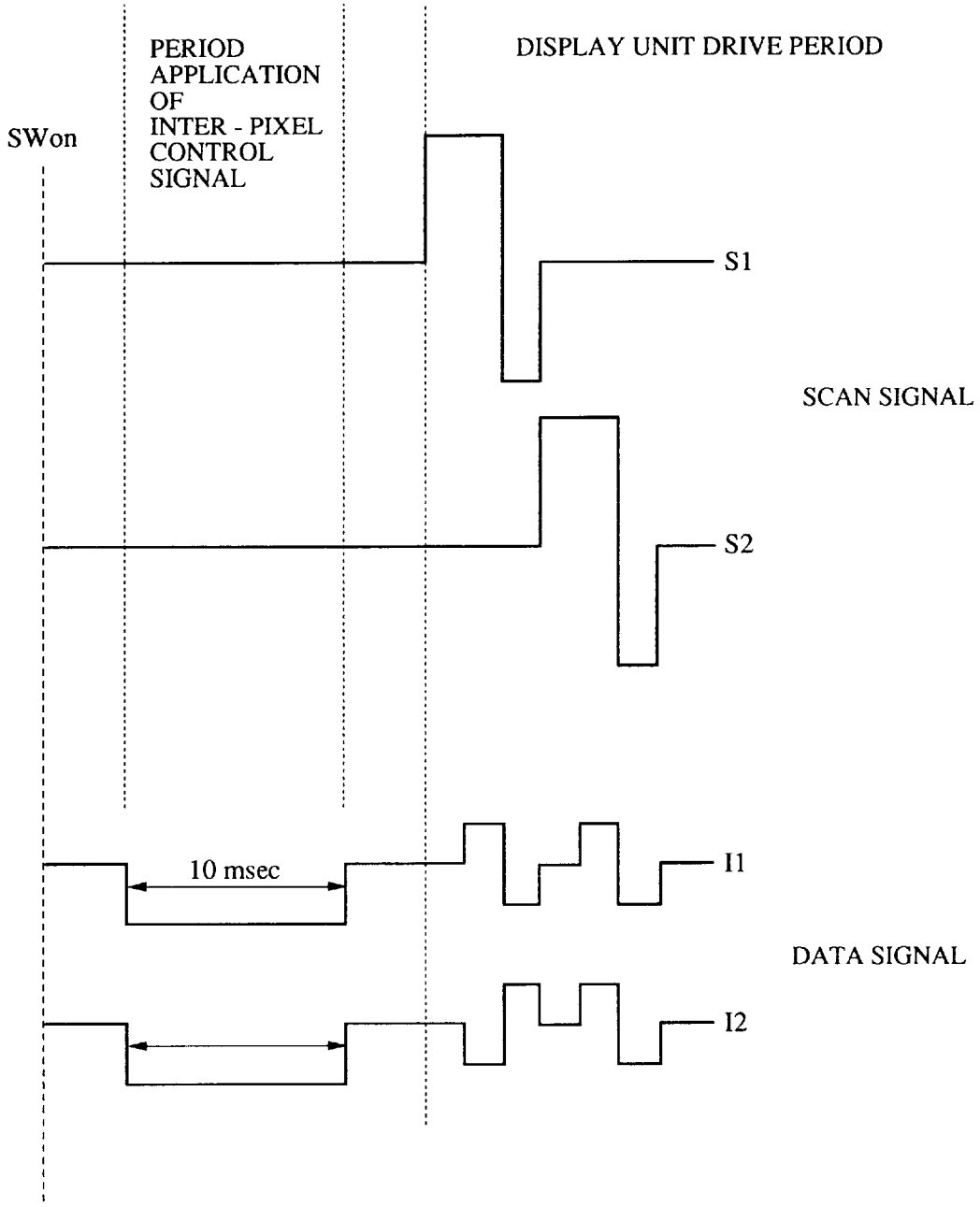
FIG. 9 is a timing chart which illustrates other display drive signals for use in the present invention.

A fourth embodiment of the present invention will now be described. Since the basic structure of a liquid crystal apparatus according to the fourth embodiment is substantially the same as the first embodiment, the same elements are given the same reference numerals and their descriptions are omitted here. This embodiment has substantially the same arrangement as that according to the first embodiment except for that mono-polar pulses having a dark state are employed in place of the bipolar pulses. When a signal group shown in FIG. 9 was applied while setting the pulse width to 10 msec, an image free from the irregular display was realized.

A fifth embodiment of the present invention will now be described. Since the basic structure of a liquid crystal apparatus according to the fifth embodiment is substantially the same as the fourth embodiment, the same elements are given the same reference numerals and their descriptions are omitted here. This embodiment is arranged similarly to the fourth embodiment except for that stripe-shape metal lines are formed in a portion of the data electrodes 1012 and that of the scan electrodes 1011 as shown in FIGS. 7A and 7B. The non-display portion control signal was evaluated, resulting in an inversion of the non-display portions 11 under substantially the same conditions as that of the fourth embodiment. When a signal group similar to that according to the fourth embodiment, and shown in FIG. 9, was applied, an image free from the irregular display was realized.

A sixth embodiment of the present invention will now be described. Since the basic structure of a liquid crystal apparatus according to the sixth embodiment is substantially the same as the fourth embodiment, the same elements are given the same reference numerals and their descriptions are omitted here. This embodiment has the same arrangement as that of the first embodiment except for ladder-type metal lines are formed in a portion of the data electrodes 1012 and that of the scan electrodes 1011 as shown in FIG. 8. The non-display portion control signal was evaluated, resulting in that the non-display portions 11 was inverted under substantially the same conditions as that of the fourth embodiment. When a signal group similar to that according to the fourth embodiment and shown in FIG. 9 was applied, an image free from the irregular display was realized.

A seventh embodiment of the present invention will now be described. Since the basic structure of a liquid crystal apparatus according to the seventh embodiment is substantially the same as the fourth embodiment, the same elements are given the same reference numerals and their descriptions are omitted here. This embodiment is arranged similarly to the first embodiment except that non-display portion control signals in the similar waveform as that according to the first embodiment are supplied to the scan electrodes 1011 from the driver and that the data electrodes 1012 are held to Vc. When the display drive signals are applied after the non-display control signals have been applied, an excellent image free from irregular display, was realized.

A preferred embodiment of the present invention may comprise an illumination means for illuminating the display panel from a rear position; and control means for, in response to receipt of the detection signal, controlling the drive means to apply, to the matrix electrode structure, signal voltage, the level of which is sufficiently high to make the optical state of the non-pixel regions to be a uniform state, before data is written on to the pixel regions by operating the drive means, the control means further controlling the illumination means to be lit off before the signal voltage is applied to the matrix electrode structure.

Assuming that the threshold voltage for changing the optical state of the ferroelectric liquid crystal in the display portions by the application of the signals to the scan electrodes and the data electrodes is V1 and the threshold voltage for changing the optical state of the ferroelectric liquid crystal in the non-display portions is V2, the voltage level of the non-display portion control signal is determined to be higher than V2 and the voltage of the display portion drive signal is determined to be a level between V1 and V2.

Further, the non-display portion control signal may be a pulse signal having a pulse width of 100 μsec to 1 sec.

Figure 10:
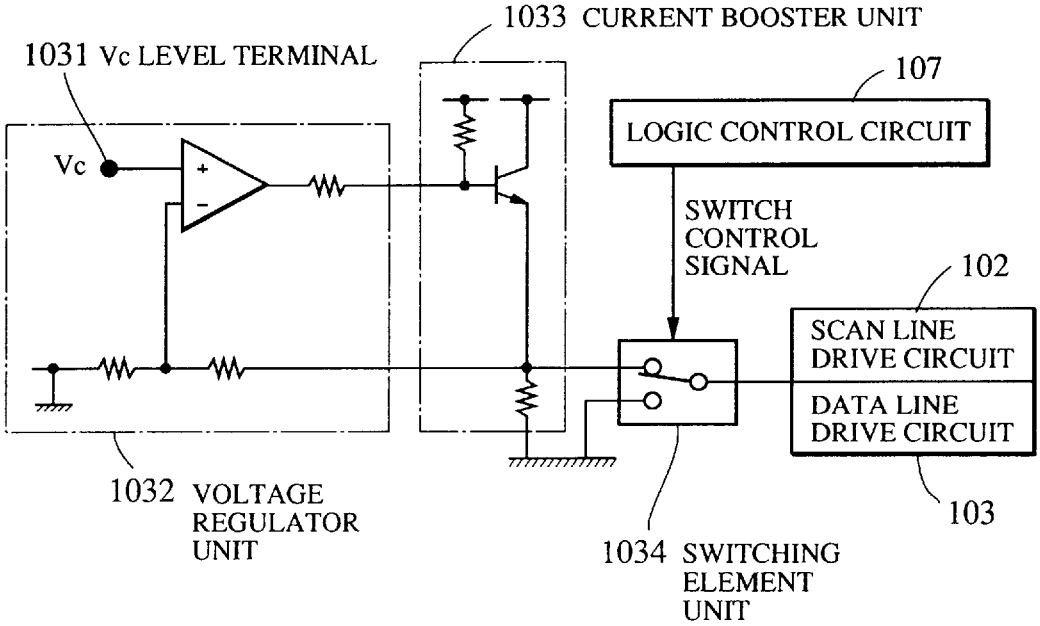
FIG. 10 is a circuit diagram which illustrates a portion of a drive voltage generating circuit for transmitting voltage Vc.

FIG. 10 is circuit diagram which illustrates a unit of drive voltage generating circuit 104 for transmitting the voltage Vc. Referring to FIG. 10, reference numeral 1031 represents a Vc level terminal, 1032 represents a voltage regulator portion, 1033 represents a current booster portion and 1034 represents a switching element portion. The switching element 1034 establishes the connection between the voltage Vc or ground potential GND to the scan line drive circuit 102 and the data line drive circuit 103 in response to the switch control signal supplied from the logic control section 107.

Figure 11:
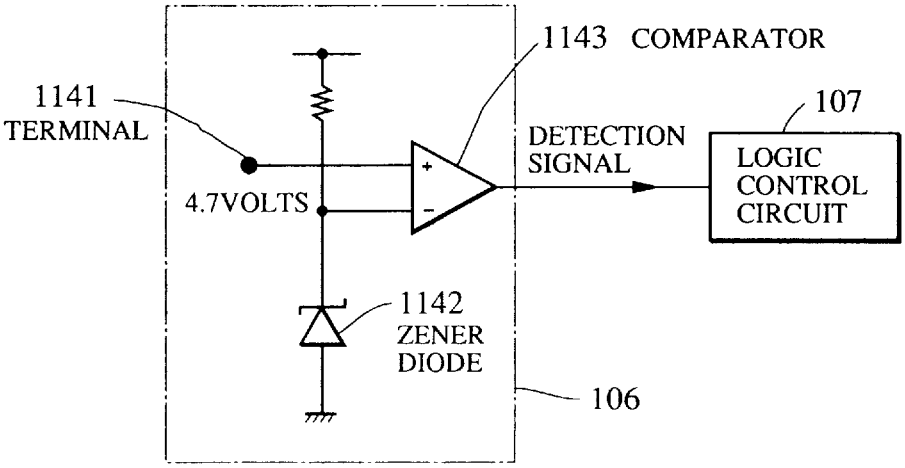
FIG. 11 is a detailed circuit diagram which illustrates a voltage detection circuit.

FIG. 11 is a circuit diagram which illustrates the voltage detection circuit 106. A terminal 1141 of the voltage detection circuit 106 is connected to the logic control voltage source 108 (see FIG. 1), the 5V logic control voltage source 108 being composed of a 4.7V zenor diode 1142 and a comparator 1143. The voltage detection circuit 106 transmits a detection signal "L" or "H" to the logic control circuit 107.

Figure 12:
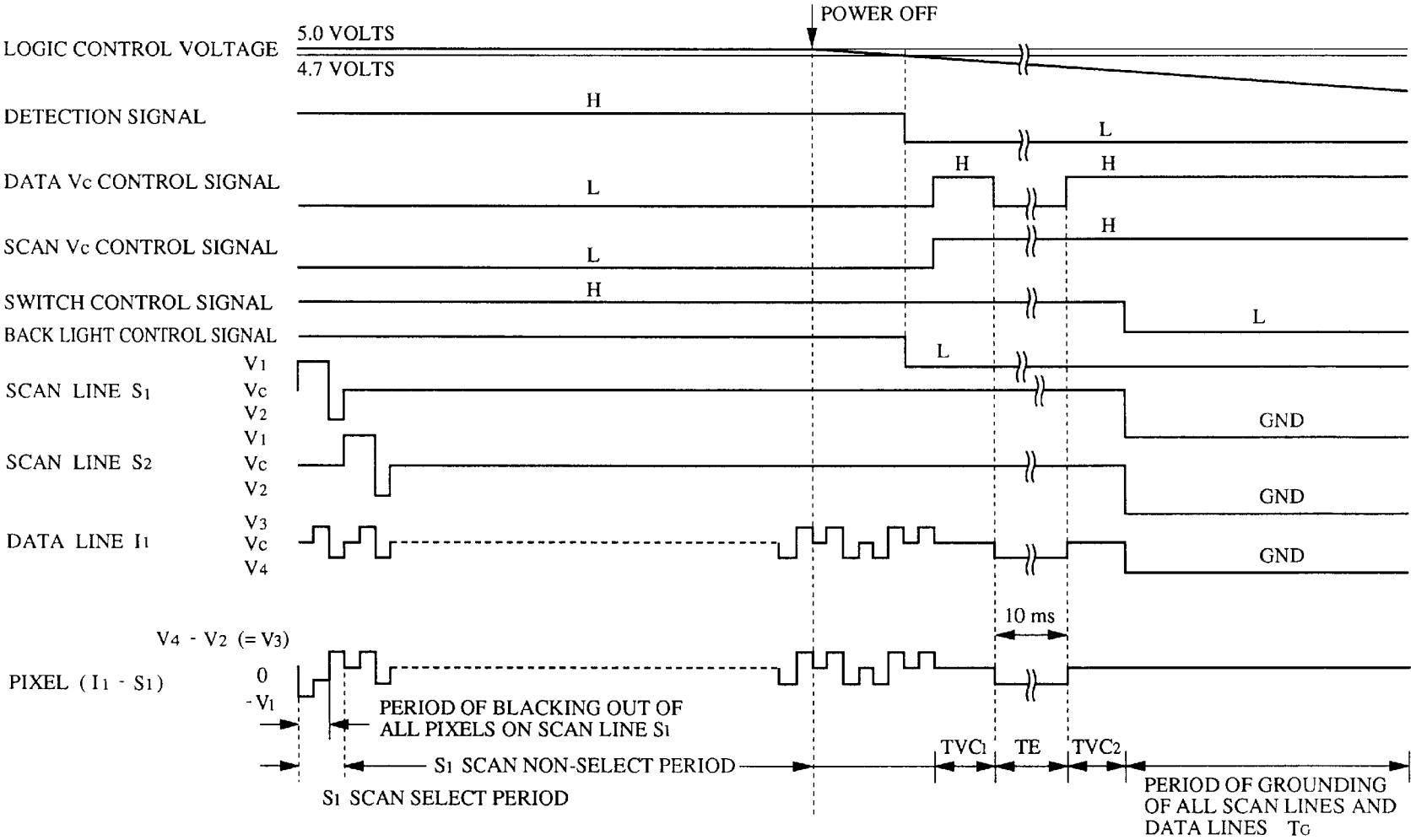
FIGS. 12, 13 and 14 are timing charts which illustrate the waveforms of output voltages.

FIG. 12 is a timing chart which time-sequentially (t: time) illustrates the output level of the logic control voltage source 108, the output level of each of the detection signal, data Vc control signal, scan Vc control signal, switch control signal and the backlight control signal, the output level (for example, the output levels to the scan lines $S_1$ and $S_2$) of the output portion of the scan line drive circuit 102, the output level (for example, the output level to data line $I_1$) from the output portion of the data line drive circuit 103, and the voltage level at pixels ($I_1$ to $S_1$) formed by the intersections of the scan lines Si and the data lines I1.

Figure 13:
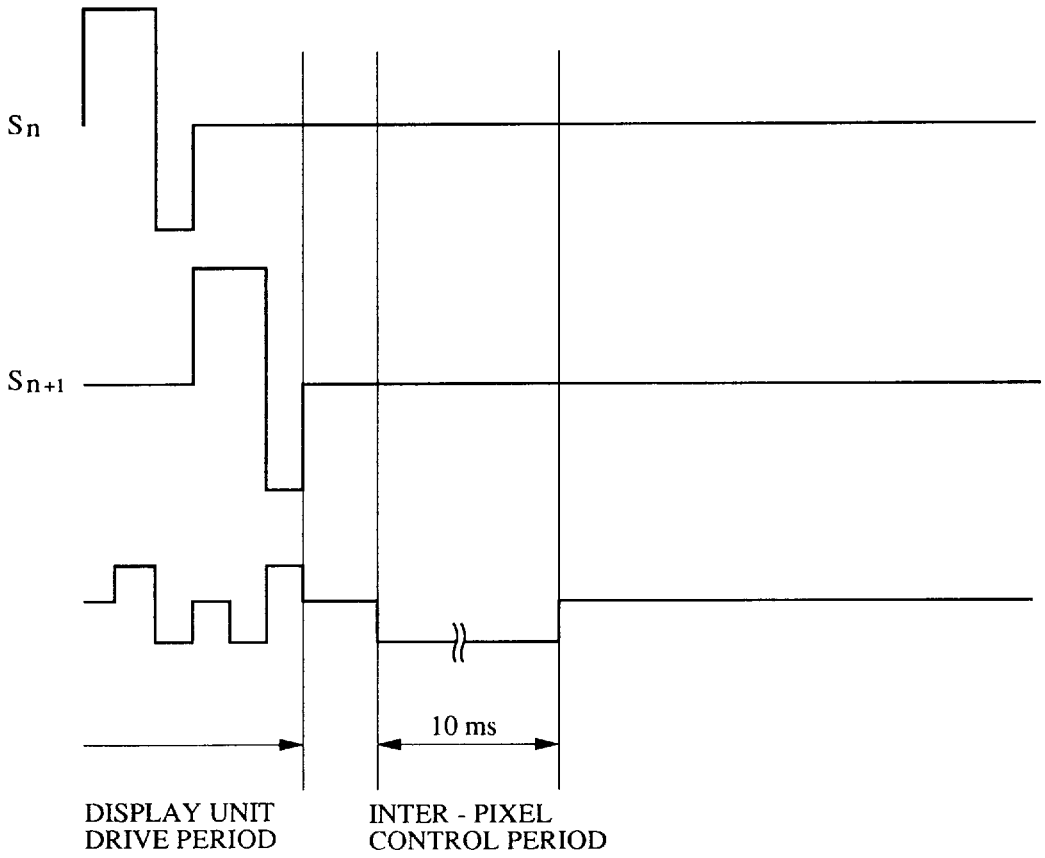
Figure 14:
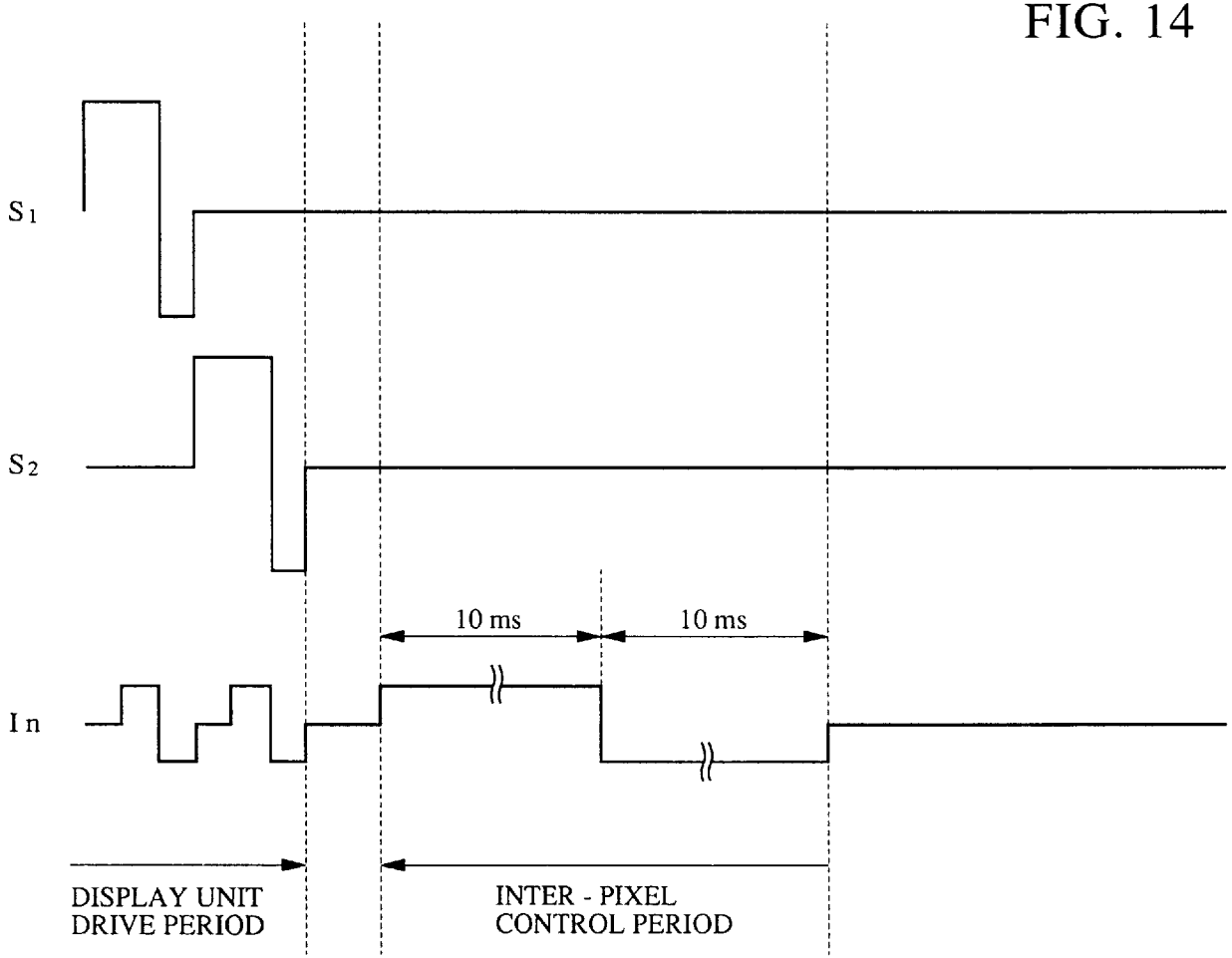

When the output voltage from the logic control voltage source 108 of the control circuit 105 has been lowered to 4.7V or lower by switching off (by turning off the power) the switch 110 of the apparatus shown in FIG. 1, the voltage detection circuit 106 generates a power-off detection signal at the "L" level as shown in FIG. 12. The logic control circuit 107 acts as follows as shown in FIGS. 12, 13 and 14: (1) the logic control circuit 107 receives the "L" level detection signal supplied from the voltage detection circuit 106, and then (2) transmits scan Vc control signal ("H" level) and data Vc control signal "H" level) to the corresponding drive circuits 102 and 103 to make all output portions to be the voltage Vc (period $T_{vc1}$), and (3) applies inter-pixel control signal in a period (TE) which is sufficiently long for regions between pixels, which are other than the intersection portions of the data and scan electrodes, to be switched off. That is, logic control circuit 107 transmits the control signals to control the drive circuits 102 and 103 as to make all of the output portions of the scan line drive circuit 102 to be the voltage Vc and to make all of the output portions of the data line drive circuit 103 to be voltage $V_4$. Then, the logic control circuit 107 (4) transmits the control signals which controls the drive circuits 102 and 103 as to make all output portions of the drive circuits 102 and 103 to be the voltage Vc for several $\mu$sec to hundreds of ms (period $T_{VC2}$), and then (5) transmits, to the drive voltage generating circuit 104, the switch control signal for starting the switching element portion 34 as to establish the connection between the output from the portion of the drive voltage generating circuit 104 for transmitting the voltage Vc and the grounding potential GND.

A structure may be employed in which the back light is lit off by lowering the level of the backlight control signal when the level of the detection signal has been lowered, or immediately thereafter so that the state of the display device is not visible to the user during a period in which the application of the inter-pixel control signal is not displayed.

It is preferable that the present invention may comprise illumination means for illuminating the display panel from a rear position; and control means for, in response to receipt of the detection signal, controlling the drive means to apply, to the matrix electrode structure, signal voltage, the level of which is sufficiently high so as to make the optical state of the non-pixel regions be a uniform state, after data has been written on to the pixel regions by operating the drive means, the control means further controlling the illumination means to be lit off before-the signal voltage is applied to the matrix electrode structure.

Figure 15:
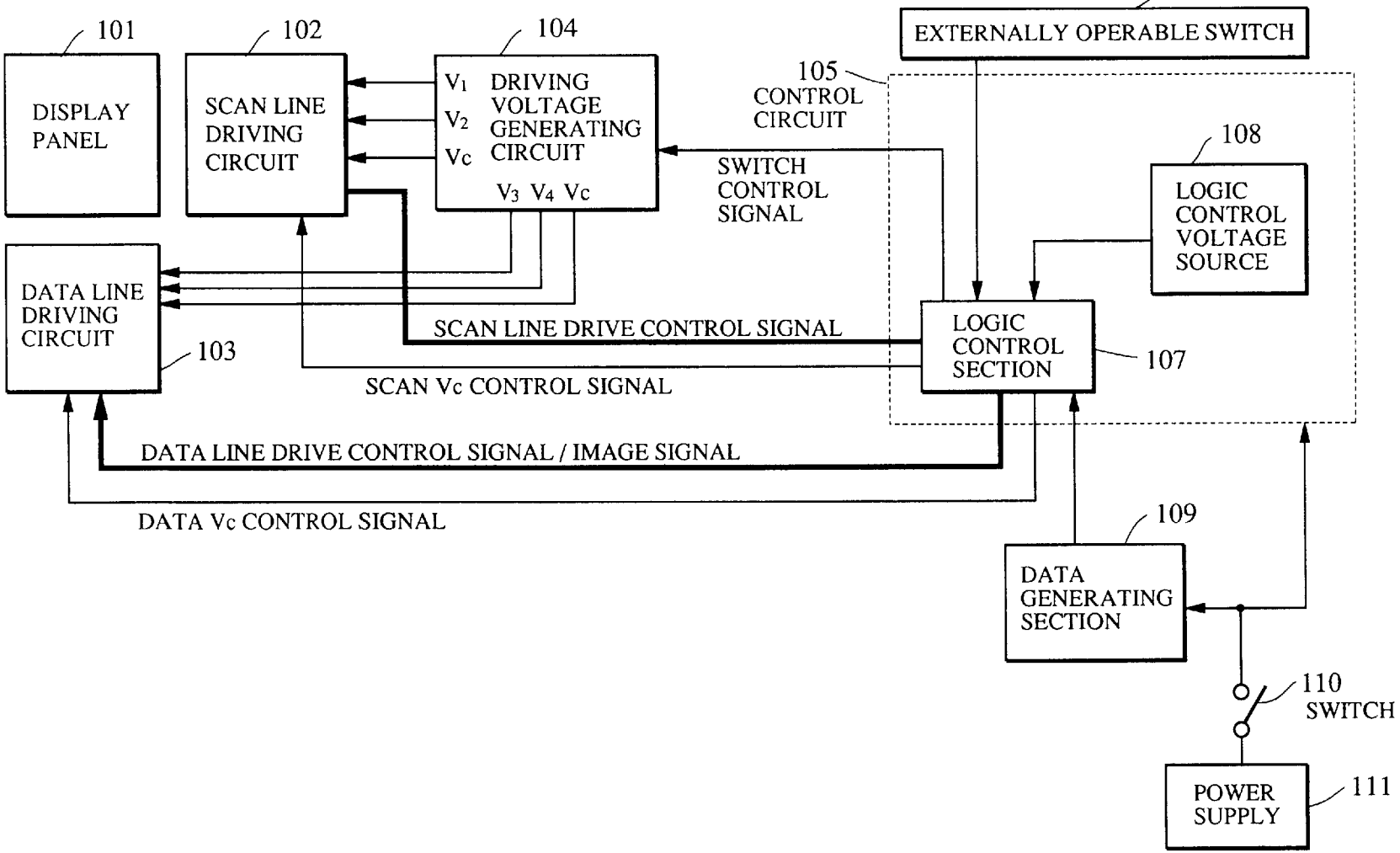
FIG. 15 is a block diagram which illustrates a display apparatus according to another embodiment of the present invention.
Figure 16:
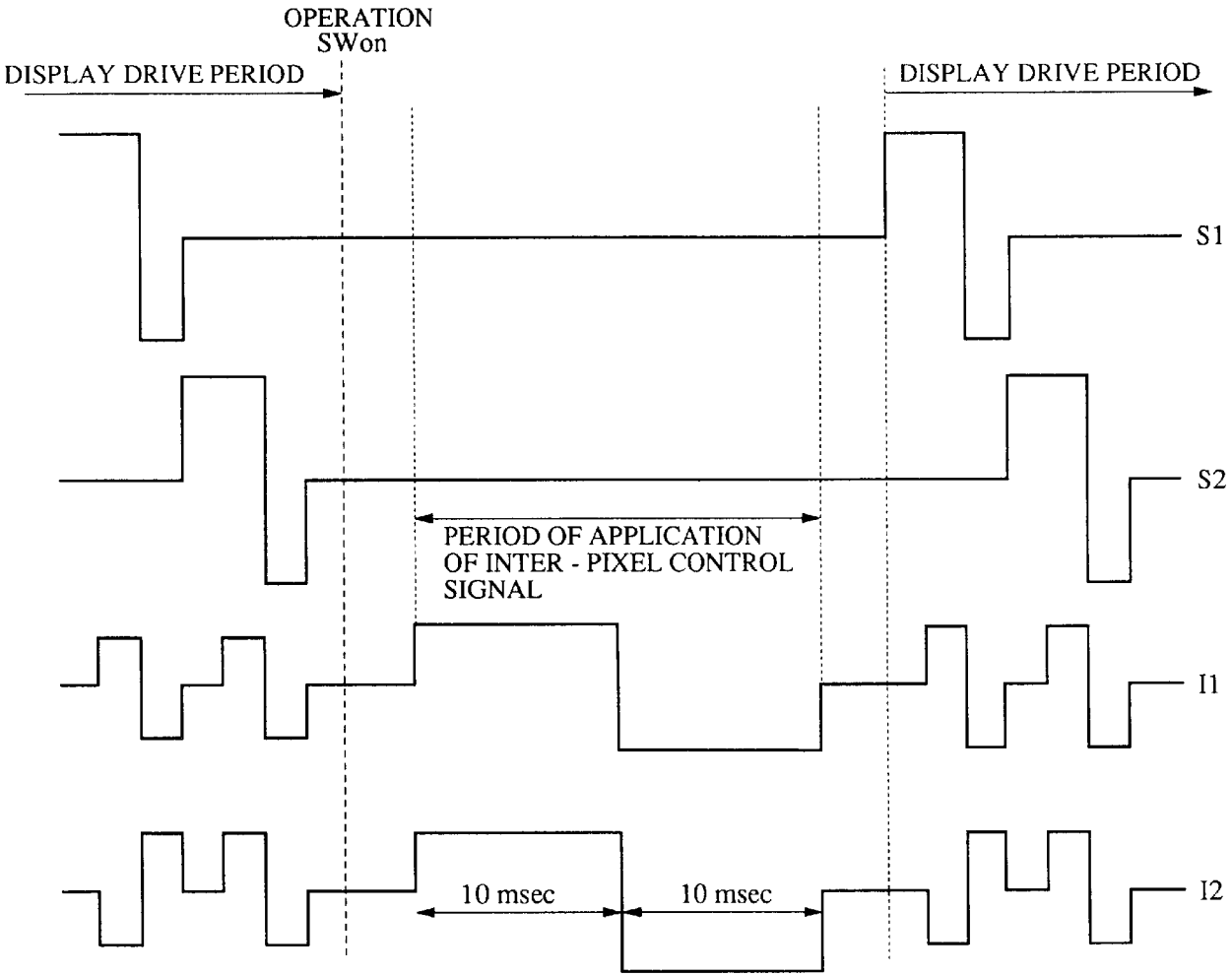
FIGS. 16, 17, 18 and 19 are timing charts which illustrate the waveforms of output voltages.
Figure 17:
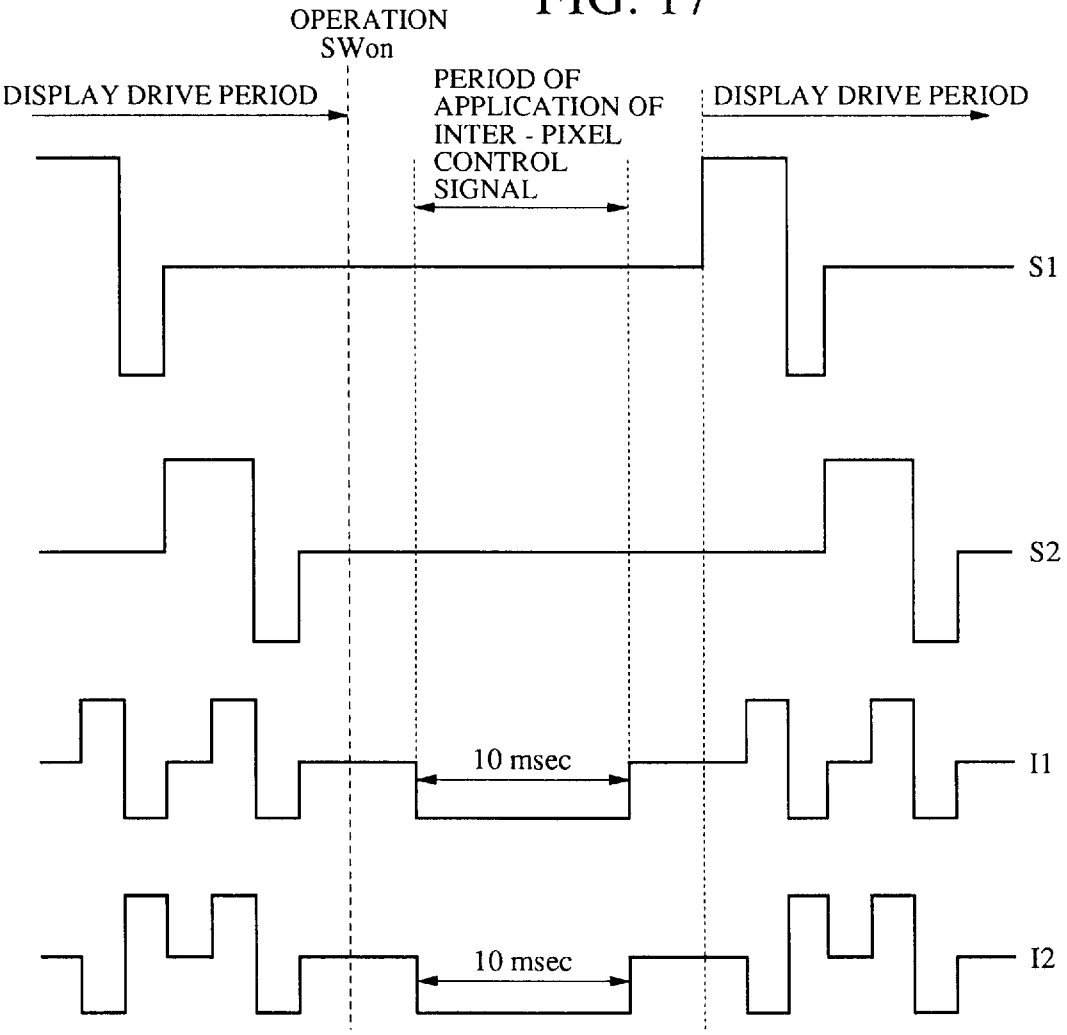
Figure 18:
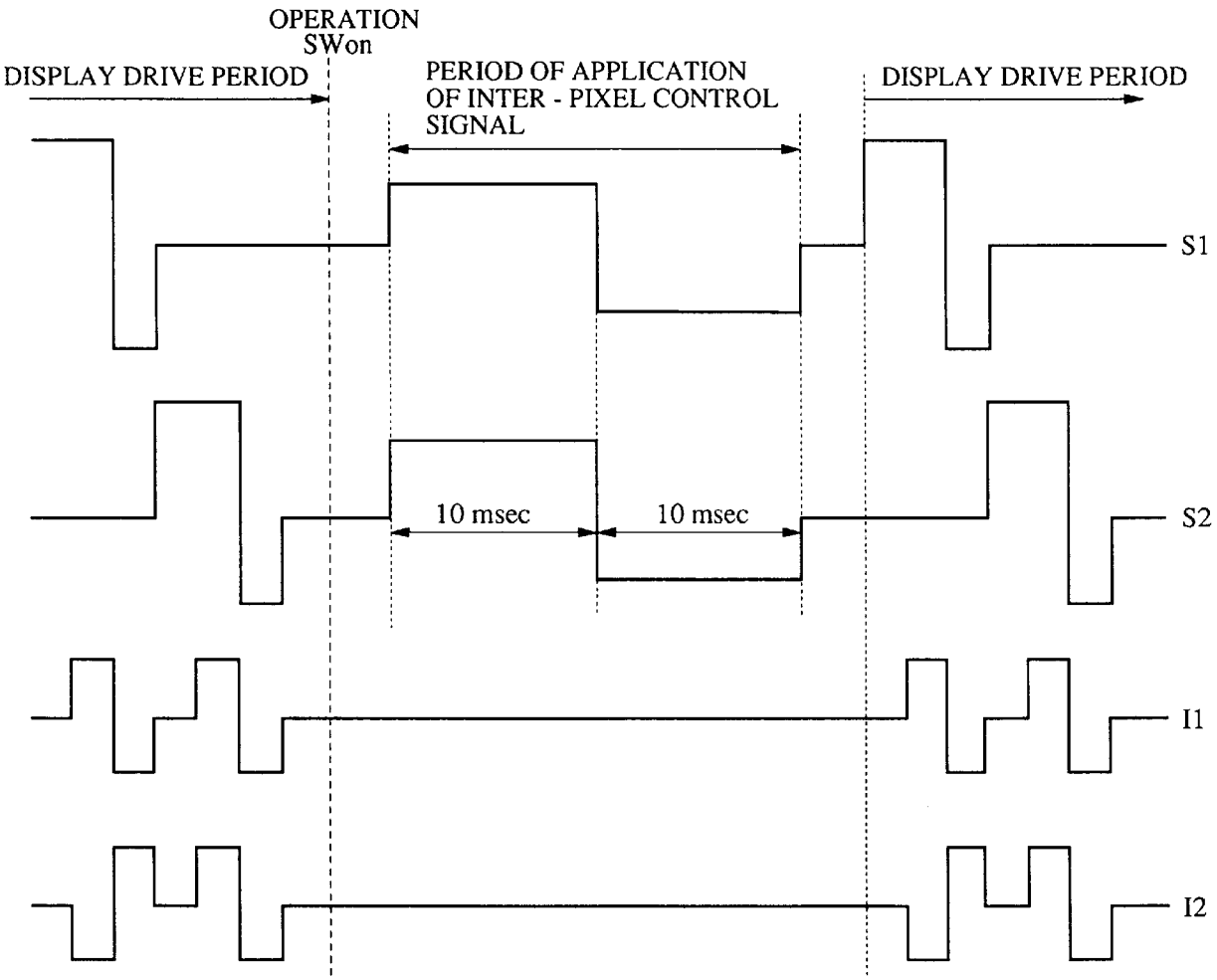
Figure 19:
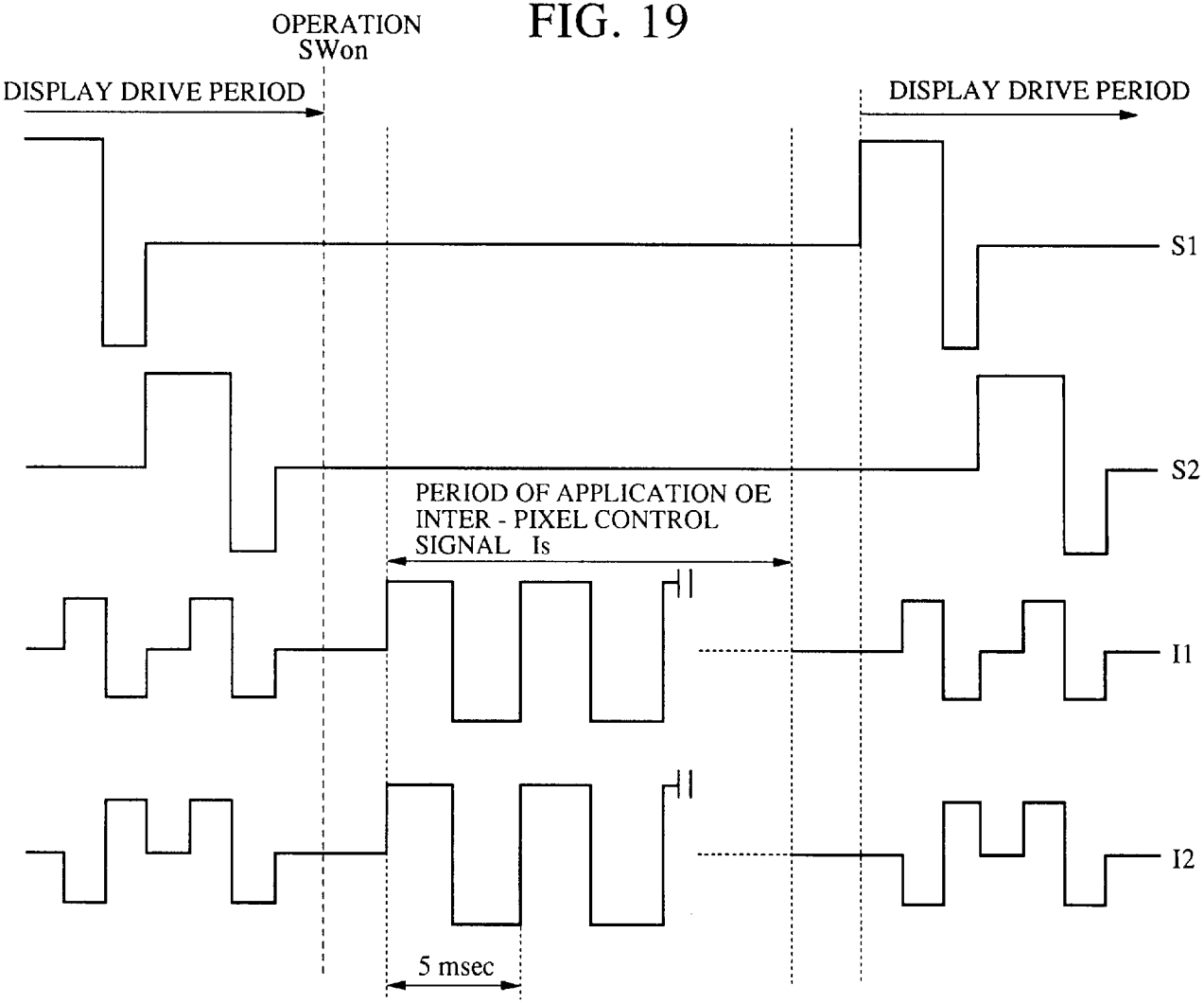
Figure 3:
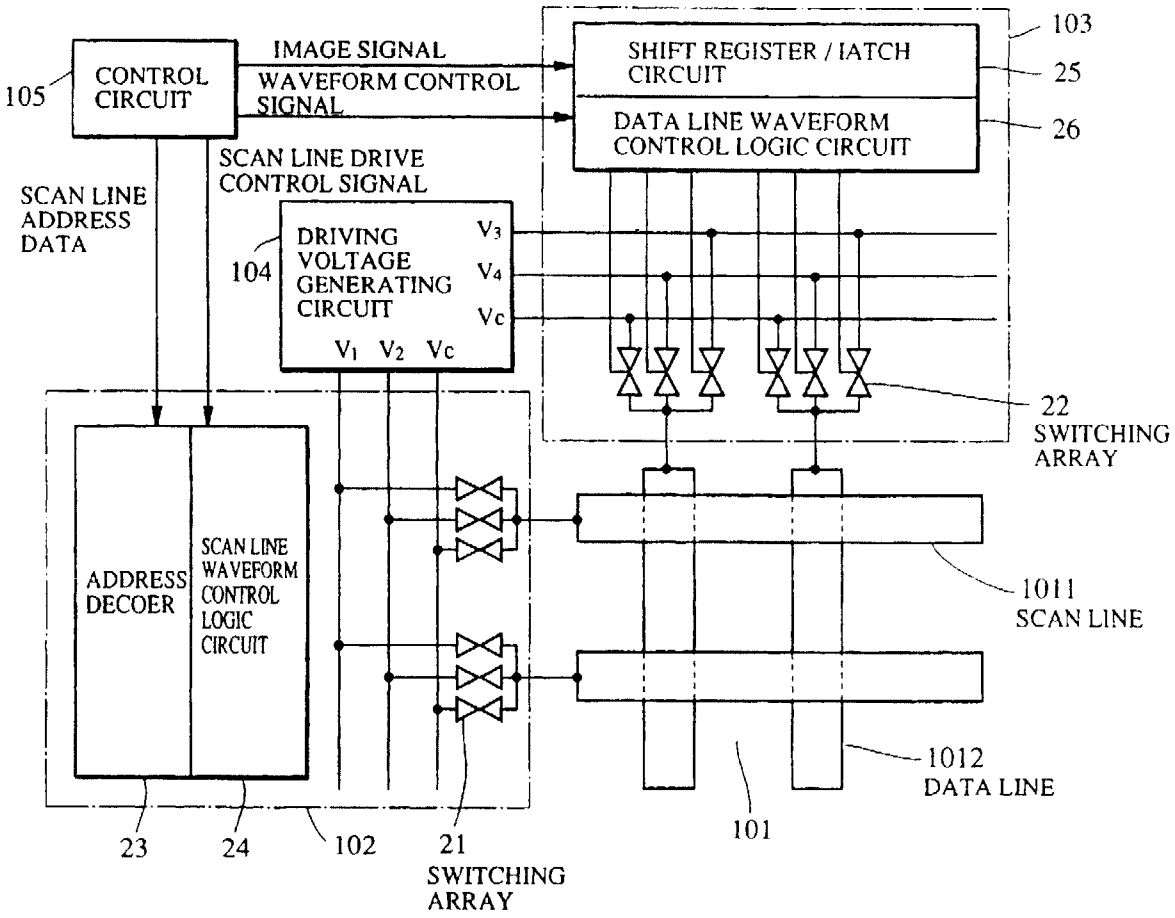

FIG. 15 is a block diagram which illustrates another embodiment of the present invention. A display apparatus shown in FIG. 15 is arranged to be similar to the display apparatus shown in FIG. 1 except for employment of an external control switch 1501 in place of the voltage detection circuit 106 for use in the display apparatus shown in FIG. 1.

FIGS. 16, 17, 18 and 19 are timing charts of a drive means of the display apparatus shown in FIG. 15.

The preferred embodiment of the present invention may comprise illumination means for illuminating the display panel from a rear position; and control means for controlling the drive means to write data onto the pixel regions after the switching means has been switched on to interrupt, in accordance with receipt of a signal for interrupting the writing operation, the writing operation when the control means has received, during the writing operation, the signal for interrupting the writing operation and to apply, to the matrix electrode structure, signal voltage, the level of which is sufficiently high to make the optical state of the non-pixel regions to be a uniform state, the control means further controlling the illumination means to be lit off before the signal voltage is applied to the matrix electrode structure.

As the display panel 101 according to this embodiment, and more particularly, as the display panel having a memory effect, a ferroelectric liquid crystal display panel disclosed in U.S. Pat. No. 4,639,089, U.S. Pat. No. 4,709,994, U.S. Pat. No. 4,712,873 or (U.S. Pat. No. 4,712,874 or an active matrix liquid crystal display panel using thin film transistors as the switching devices of pixel and disclosed in U.S. Pat. No. 4,697,887.

As the drive waveform to be used during the display period according to the embodiments of the present invention, that disclosed in U.S. Pat. No. 4,655,561 or that disclosed in U.S. Pat. No. 4,836,656 may be employed in place of the drive waveform shown in FIG. 5.

According to the foregoing embodiments, spaces between the pixels (non-pixel portions) can be controlled by a simple method so that an excellent image quality can be realized. If the same image is drawn for a long time, the state of a portion of the non-pixel portion is undesirably inverted to correspond to the state of the display. In this case, the state of the non-pixel portion cannot be controlled by display drive performed in a short time. However, the interpixel control signal can be applied by turning off the power so that the state between the pixels can be controlled to be made uniform. By using the inter-pixel control signal when the power source is turned off, the spaces between the pixels can always be in a uniform state. Therefore, the desired state of the spaces between the pixels can be stabilized in a reservation state. As a result, the inversion of the spaces between the pixels occurring due to the long-time drawing can be prevented.

By controlling the spaces between the pixels in the dark state, the leakage light quantity in the dark state can be reduced therefore improving the contrast.

The inter-pixel control signal enables the insides of the pixels to be simultaneously controlled to the dark state. In a state of the turned-off state, pixels and the spaces between the pixels can simultaneously be reserved in the black state. Further, deterioration of the image quality, such as burning, can be prevented.

As described above, the present invention is arranged so that non-display portion control signal is transmitted before the display portion drive signal is transmitted. As a result, the optical state of the liquid crystal in the non-display portions 11 is controlled. Therefore, the irregular display can be prevented and the structure can be simplified. Therefore, the structure of the system can be simplified. As a result, a liquid crystal apparatus capable of displaying excellent images can be provided while reducing the overall cost.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A display apparatus comprising:

a display panel having a matrix electrode structure in which pixel regions are formed by intersection portions of scan electrodes and data electrodes and non-pixel regions are formed by non-intersection portions;

drive means for applying scan signals to the scan electrodes and applying data signals to the data electrodes in synchronization with the scan signals;

drive voltage generating means for supplying drive voltage to said drive means;

a power supply source for supplying power to said drive voltage generating means;

switching means for switching ON/OFF the electrical connection between said drive voltage generating means and said power supply source;

detection means for detecting whether or not said switching means has been switched on and generating a detection signal in response to the detection; and control means for, in response to receipt of the detection signal, controlling said drive means so as to apply a constant voltage $V_c$ to the scan electrodes and apply, to the data electrodes, a signal voltage of a level sufficiently high to cause the non-pixel regions to achieve a uniform optical state, at a period for interrupting a writing operation of the pixel regions by said drive means and after said writing operation.

2. A display apparatus according to claim 1 further comprising means for setting the uniform optical state of the non-pixel regions to a dark state.

3. A display apparatus according to claim 1, wherein liquid crystal is enclosed among the scan electrodes and the data electrodes.

4. A display apparatus according to claim 3, wherein the liquid crystal is ferroelectric liquid crystal.

5. A display apparatus comprising:

a display panel having a matrix electrode structure in which pixel regions are formed by intersection portions of scan electrodes and data electrodes and non-pixel regions are formed by non-intersection portions;

drive means for applying scan signals to the scan electrodes and applying data signals to the data electrodes in synchronization with the scan signals;

drive voltage generating means for supplying drive voltage to said drive means;

a power supply source for supplying power to said drive voltage generating means;

switching means for switching ON/OFF the electrical connection between said drive voltage generating means and said power supply source;

detection means for detecting whether or not said switching means has been switched on and generating a detection signal in response to the detection; and control means for, in response to receipt of the detection signal, controlling said drive means so as to apply a constant voltage $V_c$ to the scan electrodes and apply, to the data electrodes, a signal voltage of a level sufficiently high to cause the non-pixel regions to achieve a uniform optical state, at a period for interrupting a writing operation of the pixel regions by said drive means and after said writing operation.

6. A display apparatus according to claim 5 further comprising means for setting the uniform optical state of the non-pixel regions to a dark state.

7. A display apparatus according to claim 5, wherein liquid crystal is enclosed among the scan electrodes and the data electrodes.

8. A display apparatus according to claim 7, wherein the liquid crystal is ferroelectric liquid crystal.

9. A display apparatus comprising:

a display panel having a matrix electrode structure in which pixel regions are formed by intersection portions of scan electrodes and data electrodes and non-pixel regions are formed by non-intersection portions;

drive means for applying scan signals to the scan electrodes and applying data signals to the data electrodes in synchronization with the scan signals;

drive voltage generating means for supplying drive voltage to said drive means;

a power supply source for supplying power to said drive voltage generating means;

switching means for switching ON/OFF the electrical connection between said drive voltage generating means and said power supply source; and control means for controlling said drive means to write data onto the pixel regions after said switching means has been switched on, to interrupt, in accordance with receipt of a signal for interrupting the writing operation when said control means has received, during the writing operation, the signal for interrupting the writing operation and to apply a constant voltage $V_c$ to the scan electrodes and apply, to the data electrodes, a signal voltage of a level sufficiently high to cause the non-pixel regions to achieve a uniform optical state.

10. A display apparatus according to claim 9 further comprising means for setting the uniform optical state of the non-pixel regions to a dark state.

11. A display apparatus according to claim 9, wherein liquid crystal is enclosed among the scan electrodes and the data electrodes.

12. A display apparatus according to claim 11, wherein the liquid crystal is ferroelectric liquid crystal.

13. A display apparatus comprising:

a display panel having a matrix electrode structure in which pixel regions are formed by intersection portions of scan electrodes and data electrodes and non-pixel regions are formed by non-intersection portions;

drive means for applying scan signals to the scan electrodes and applying data signals to the data electrodes in synchronization with the scan signals;

drive voltage generating means for supplying drive voltage to said drive means;

a power supply source for supplying power to said drive voltage generating means;

switching means for switching ON/OFF the electrical connection between said drive voltage generating means and said power supply source;

detection means for detecting whether or not said switching means has been switched on and generating a detection signal in response to the detection;

illumination means for illuminating said display panel from a rear position; and control means for, in response to receipt of the detection signal, controlling said drive means so as to apply a constant voltage $V_c$ to the scan electrodes and apply, to the data electrodes, a signal voltage of a level sufficiently high to cause the non-pixel regions to achieve a uniform optical state, at a period for interrupting a writing operation of the pixel regions by said drive means and before said writing operation, said control means further controlling said illumination means so as to be lit off at the period for interrupting said writing operation of the pixel regions and before said writing operation.

14. A display apparatus according to claim 13 further comprising means for setting the uniform optical state of the non-pixel regions to a dark state.

15. A display apparatus according to claim 13, wherein liquid crystal is enclosed among the scan electrodes and the data electrodes.

16. A display according to claim 15, wherein the liquid crystal is ferroelectric liquid crystal.

17. A display apparatus comprising:

a display panel having a matrix electrode structure in which pixel regions are formed by intersection portions of scan electrodes and data electrodes and non-pixel regions are formed by non-intersection portions;

drive means for applying scan signals to the scan electrodes and applying data signals to the data electrodes in synchronization with the scan signals;

drive voltage generating means for supplying drive voltage to said drive means;

a power supply source for supplying power to said drive voltage generating means;

switching means for switching ON/OFF the electrical connection between said drive voltage generating means and said power supply source;

detection means for detecting whether or not said switching means has been switched on and generating a detection signal in response to the detection;

illumination means for illuminating said display panel from a rear position; and control means for, in response to receipt of the detection signal, controlling said drive means so as to apply a constant voltage $V_c$ to the scan electrodes and apply, to the data electrodes, a signal voltage of a level sufficiently high to cause the non-pixel regions to achieve a uniform optical state, at a period for interrupting a writing operation of the pixel regions by said drive means and after said writing operation, said control means further controlling said illumination means so as to be lit off at the period for interrupting a writing operation of the pixel regions and before the writing operation.

18. A display apparatus according to claim 17 further comprising means for setting the uniform optical state of the non-pixel regions to a dark state.

19. A display apparatus according to claim 17, wherein liquid crystal is enclosed among the scan electrodes and the data electrodes.

20. A display apparatus according to claim 19, wherein the liquid crystal is ferroelectric liquid crystal.

21. A display apparatus comprising:

a display panel having a matrix electrode structure in which pixel regions are formed by intersection portions of scan electrodes and data electrodes and non-pixel regions are formed by non-intersection portions;

drive means for applying scan signals to the scan electrodes and applying data signals to the data electrodes in synchronization with the scan signals;

drive voltage generating means for supplying drive voltage to said drive means;

a power supply source for supplying power to said drive voltage generating means;

switching means for switching ON/OFF the electrical connection between drive voltage generating means and said power supply source;

illumination means for illuminating said display panel from a rear position; and control means for controlling said drive means to write data onto the pixel regions after said switching means has been switched on, to interrupt, in accordance with receipt of a signal for interrupting the writing operation when said control means has received, during the writing operation, the signal for interrupting the writing operation and to apply a constant voltage $V_c$ to the scan electrodes and apply, to the data electrodes, a signal voltage of a level sufficiently high to cause the non-pixel regions to achieve a uniform optical state, said control means further controlling said illumination means to be lit off before the signal voltage is applied to the matrix electrode structure.

22. An apparatus according to claim 21 further comprising means for setting the uniform optical state of the non-pixel regions to a dark state.

23. An apparatus according to claim 21, wherein liquid crystal is enclosed among the scan electrodes and the data electrodes.

24. An apparatus according to claim 23, wherein the liquid crystal is ferroelectric liquid crystal.

* * * * *

UNITED STATES PATENT AND TRADEMARK OFFICE

CERTIFICATE OF CORRECTION

PATENT NO. : 5,815,133

DATED : September 29, 1998

INVENTOR(S): AKIRA TSUBOYAMA ET AL.

It is certified that error appears in the above-identified patent and that said Letters Patent is hereby corrected as shown below:

In the drawings

Fig. 3, "/IATCH" should read --/LATCH--.

COLUMN 1

Line 40, "and to" should read --and--;
Line 53, "irregular ities" should read --irregularities--.

COLUMN 2

Line 56, "will be" should read --will--.

COLUMN 4

Line 5, "transmit" should read --transmits--;
Line 38, "aforementioned." should read --aforementioned gaps--;
Line 56, "switched" should read --switch--.

UNITED STATES PATENT AND TRADEMARK OFFICE

CERTIFICATE OF CORRECTION

PATENT NO. : 5,815,133

DATED : September 29, 1998

INVENTOR(S): AKIRA TSUBOYAMA ET AL.

It is certified that error appears in the above-identified patent and that said Letters Patent is hereby corrected as shown below:

COLUMN 5

Line 18, "1011" (second occurrence) should read --1012--;
Line 35, "1011" should read --1012-- and "1012." should read --1011.--;
Line 47, "except for" should read --except that--;
Line 51, "was inverted" should read --were inverted--;
Line 63, "except for that" should read --except that--.

COLUMN 6

Line 7, "except for that" should read --except that--;
Line 26, "was inverted" should read --were inverted--;
Line 43, "image" should read --image,--;
Line 66, "is circuit" should read --is a circuit--.

COLUMN 7

Line 28, "Si" should read --$S_1$-- and "I1." should read --$I_1$.--;
Line 47, "as to" should read --so as to--.

UNITED STATES PATENT AND TRADEMARK OFFICE

CERTIFICATE OF CORRECTION

PATENT NO. : 5,815,133

DATED : September 29, 1998

INVENTOR(S): AKIRA TSUBOYAMA ET AL.

It is certified that error appears in the above-identified patent and that said Letters Patent is hereby corrected as shown below:

COLUMN 8

Line 8, "before-the" should read --before the--;
Line 37, "(U.S." should read --U.S.--;
Line 65, "reduced" should read --reduced,-- and "therefore" should read --thereby--.

Signed and Sealed this

Fifteenth Day of June, 1999

*Attest:*

Q. TODD DICKINSON

*Attesting Officer*

*Acting Commissioner of Patents and Trademarks*